US008366291B2

(12) United States Patent
Hoffmann

(10) Patent No.: US 8,366,291 B2
(45) Date of Patent: Feb. 5, 2013

(54) LIGHTING DEVICE

(76) Inventor: Friedemann Hoffmann, Gava (ES)

( * ) Notice: Subject to any disclaimer, the term of this patent is extended or adjusted under 35 U.S.C. 154(b) by 697 days.

(21) Appl. No.: 12/520,925

(22) PCT Filed: Dec. 28, 2006

(86) PCT No.: PCT/ES2006/000720

§ 371 (c)(1),
(2), (4) Date: Jun. 23, 2009

(87) PCT Pub. No.: WO2008/077973

PCT Pub. Date: Jul. 3, 2008

(65) Prior Publication Data

US 2010/0061095 A1 Mar. 11, 2010

(51) Int. Cl.
*F21S 4/00* (2006.01)

(52) U.S. Cl. ... 362/222; 362/223; 362/225; 362/249.02; 362/249.03; 362/249.04

(58) Field of Classification Search ..... 362/222–223, 362/225, 240, 246, 249.02–249.04
See application file for complete search history.

(56) References Cited

U.S. PATENT DOCUMENTS 6,186,645 B1 * 2/2001 Camarota ..... 362/249.11
7,213,941 B2 * 5/2007 Sloan et al. ..... 362/246

* cited by examiner

*Primary Examiner* — Diane Lee
*Assistant Examiner* — Sean Gramling
(74) *Attorney, Agent, or Firm* — Notaro, Michalos & Zaccaria P.C.

(57) ABSTRACT

Device including a tubular element (1), with a flexible printed circuit (3) of conducting tracks (32) on which are a number of LED diodes (31) and contact ports (33) for supply thereof; a flexible cover (2), formed by a coextruded profile with a diffuser back (21), configured in a flexible material and a base (22) made of a material of greater rigidity; said base includes a longitudinal aperture (23) and a set (25) of male and female configurations connectable by pressure for opening and closing the inner recess (24) for reception of the printed circuit (3); and an external connector (4), comprising two sets of electrically conducting connection pins (41*a*, 41*b*), or a holder (42*c*) with contacts (40) for the electric contact of the ports (33) and tracks (32), to terminals (45) for connection to the external supply.

15 Claims, 6 Drawing Sheets

LIGHTING DEVICE

OBJECT OF THE INVENTION

The present invention relates to a lighting device of the type formed by a tubular element with a flexible and translucent cover housing a flexible printed circuit in its interior having a plurality of luminous LED diodes, in such a manner that the device assembly configures an elongated and slender lighting element, simulating a neon tube or similar.

BACKGROUND OF THE INVENTION

At present, the use of linear lighting elements has become extended to multiple uses. For example, we are aware of the use of neon tubes formed by a transparent glass tube housing a neon gas and mixture of noble gases in its interior, for ionisation to be produced by means of an electric discharge system, emitting a very striking coloured light. The aforementioned glass tubes many be formed into curves and angles with relative ease by an expert installer, due to which they are widely used to outline buildings and in luminous marquees. However, their energy consumption and the fragility of said tubes in the environment makes their use require considerable maintenance.

Lighting installations have also been carried out using optical fibre, which may be used on floors and walls, faintly diffusing the light from a light source disposed at one end; however, it cannot be of great length, given that the optical fibre alone does not project the light, but rather transmits that produced by the light source, disposed at one end and with limited power output.

Utility Model U200402192 by Ben Fan is known, which discloses a luminous cord formed by a flexible inner core having two embedded conduction wires to which a plurality of LED diodes disposed in recesses or housings for such purpose are connected. This flexible core is disposed next to an upper diffusing element within an extruded synthetic casing, in such a manner as to create a flexible monoblock unit which, by means of an adequate connector, allows its use in interior or exterior decoration. However, this device poses several problems. Firstly, the distributor or marketer of this element requires considerable storage capacity in order to have a variety of LED colour combinations and exterior casing colours. Additionally, in the event that a specific casing colour is requested, the factory order must be placed for manufacture thereof with the cost and delivery delay that this implies. Additionally, during wiring, the connectors may have contact problems, as the connection with the wires embedded in the cord is made by pinching from one end, due to which the contact is not ensured if the luminous cord is bent to one side or the other.

Application PCT WO2005/106320 of the firm Sloanled Inc. is also known, wherein a perimeter flexible lighting device formed by a tubular element with a flexible printed circuit of conducting tracks on which light-emitting LED diodes are disposed. The tubular element also comprises a flexible cover for housing and protecting the flexible printed circuit. This cover includes diffusion and/or colouring properties of the emitted light based on combinations with the LED diodes that may be very varied. However, the sale and distribution of these lighting devices continue requiring the use of large storage spaces in order to have the widest possible variety of products.

Spanish Utility Model ES1057349 of this same applicant is also known as "Modular Lighting Device", which discloses a type of lighting module composed of an integrated circuit carrying a plurality of lighting elements and conducting tracks for selective electrical supply thereof, said components being embedded in an extruded profile made of resin or electrically insulating material. The integrated circuit includes conducting tracks with metal inserts having ports for the external connection thereof by means of intermediate spacers and tie plates, which are fixed by means of passage screws. This construction is bulky and has a delicate structure, as the tie plates may be of considerable length and rigid, hampering folding and curving of the module. Additionally, given the cross-sectional size of the extruded resin profile and secondary tracks, the screws are small in size and difficult to handle.

DESCRIPTION OF THE INVENTION

The lighting device, of this invention, includes technical peculiarities designed to allow better manufacturing and installation, reducing the need for storage volume and availability of different combinations of LED lighting colour and outer colour of the cover or casing of the tubular element.

In accordance with the invention, the flexible cover, which includes a longitudinal aperture has, in correspondence with said aperture, a set of longitudinal configurations, male and female, mutually opposed, connectable and disconnectable by pressure, which allows the watertight closure of said inner recess, after having introduced the flexible printed circuit with the LED diodes. In this manner material storage needs are reduced, as the distributor may separately store the printed circuits with LED diodes of different colours and flexible covers also of different colours, which allows a reduction in the number of references in stock and the installer, upon receipt of the order, can combine the desired cover and luminous printed circuit immediately. In an alternative, it is only necessary to keep a few references of the printed circuit with the coloured LEDs, and the cover is prepared or assembled upon receipt of the order combining both, given that the manufacture and assembly of said cover is easier, faster and cheaper than that of the inner luminous element, with greater added value.

The flexible cover may be formed by a coextruded profile with a diffuser back configured in a polymer material of greater flexibility and a base made of a polymer material of greater rigidity.

This diffuser back may preferably include a longitudinal inner recess, responsible for diffusing the light emitted by the LED diodes in such a manner that the spaces between the substantially proximate points of light cannot be seen from the exterior, but rather continuous lighting is observed. This recess also acts as a cushion in the event of receiving impacts or being walked on in floor installations.

The back may be arch-shaped or flat, the cover having a preferably rectangular cross-section, suitable for the embedded and levelled installation thereof on a surface, such as the floor.

The cover may include longitudinal slots and/or projections for fastening its lower end to a holder profile or staple that allows anchoring thereof to any surface.

The cover has high resistance to humidity, abrasion, friction and flattening, for use thereof both in interiors and exteriors, even if folded and bent, on being extremely flexible. In order to ensure the electrical insulation of the flexible printer circuit and LED diodes, these have been envisaged to be housed inside a tubular protector made of an insulating polymer, such as an external extruded polymer, which is flexible and sufficiently transparent. This tubular protector increases protection against humidity and environmental water which may affect the tubular element according to high standards, such as IP67. The flexibility of the outer cover allows it to act as a duly embedded expansion joint, eliminating the hollow space or outer covers.

In the event of its use in exteriors, both the cover and the tubular protector are formed by polymers with ultraviolet ray-resistant additives. In order to also increase its mechanical resistance the cover has been envisaged to include, in an alternative embodiment, a circular or oval cross-section, which is more stable and has greater recovery.

The outer cover also allows the device to be used in interiors, as it is resistant to chemical agents, such as for example those used to clean floors and walls.

In order to solve the connection problems, which are repeated in the existing devices, the flexible printed circuit comprises electrically conducting ports, made directly or in contact with the supply tracks of the LED diodes for connection thereof by means of an adequate external connector. The device comprises a connector having contact elements and fixed to said flexible printed circuit ports.

The printed circuit may be internally configured according to discrete cross-sections of LED diodes disposed in series, in such a manner that the contact ports are discretely disposed throughout its length. In order for the installer to be able to know which is the cut-off and installation point of the connector on the cover, the latter comprises one or several marks indicating the location of said contact ports. In turn, the ports are disposed at different heights with respect to the cross-section of the printed circuit, thereby avoiding or reducing the possibility of the incorrect installation of the contact elements of the connector, causing the crossed polarisation of the LED diodes, which could lead to their destruction.

In a first embodiment, the connector comprises two sets of conducting pins as contact elements, disposed in opposition for clamping and fastening the rigid conducting rings located in the aforementioned ports of the printed circuit, which is transversely disposed between both sets of pins. These pins are related to terminals for connection to the external supply and protected by an outer casing that ensures the watertightness of the assembly and of the external supply cable entrance. In this manner, the contact between the rigid external connector and flexible printed circuit is ensured, even if the flexible cover of the tubular element is twisted.

In each ring, the outline of the central orifice has a conical or converging shape on either side, in such a manner that when the pins enter therein, adequate contact is made, even if said pins are displaced with respect to the centre of the ring.

Each set of connection pins is disposed on an independent holder, in such a manner that the connection is ensured through the two opposing holders that are introduced by locking into the material of the cover until establishing contact with the rings on either side. Thus, the holder ensures that the cover of the tubular element does not move and the inner printed circuit is adequately connected. This independent holder may be a conventional, rigid, printed circuit board.

The outer casing of the connector is mainly formed by two interconnectable, longitudinal semi-casings, defining an entrance mouth at one end of the tubular element, having dimensions substantially similar to the outline of the flexible cover, and a supply cable exit. In this layout, the supply of the LED diodes is carried out from one end of the tubular element, but it is possible to carry out the supply from any intermediate point where the printed circuit has connection ports and rings.

In a preferred embodiment, the supply cable exit is carried out by means of two semi-threads formed on the semi-casing and closed by a gland. The casing may be completely closed in any conventional manner, such as by screws or similar.

The connector casing, disposed at the end of the tubular element, has at least one cover penetration-limiting inner stop before making the connection. If cover and circuit cut-off has been made adequately, said stops will cause the contact rings of the inner printed circuit to be disposed in an almost ideal layout for their contact when the connection pins are introduced through the cover.

The casing mouth through which the tubular element is introduced comprises an elastic watertight joint connectable around the cover. This joint prevents water from entering the interior of the connector casing, on intimately adapting to the outline of the cover, absorbing its movements during installation and handling of the device.

In a preferred embodiment, each pin holder is solidly joined to one of the semi-casings. This allows the assembly and contact between the rings and pins to be carried out simply by pressure applied by the installation operator to the semi-casings when the cover and printed circuit are fully introduced. The incorrect installation of any of the elements causes the semi-casings not to close correctly, which can be easily observed.

Each pin holder may be solidly joined to one of the semi-casings, for example by means of screws or similar.

The contact pins corresponding to the same polarity in both holders are electrically connected to the same terminals for connection to the external electric supply cable. In this manner the electrical contact is ensured, as if one of the pins does not establish adequate electrical contact due to bending of the printed circuit, its complement will.

Said sets of complementary pins envisage that for each polarity one pin is thicker than its complement, in order to ensure greater centring and adjustment of the ring when connecting the device.

In a second alternative embodiment, the contact elements of the connector comprise a holder with two connection contacts wherein screws disposed through the ports may be connected once a portion of the tubular polymer protector has been eliminated. These contacts are related to the corresponding terminals for connection to the external supply for the operation thereof.

The holder of the contacts on a printed circuit board or similar that is attached to the inner side of one of the semi-casings. The tubular element has an external cover cut in such a manner that it adjusts to the entrance of the connector casing with part of the flexible printed circuit projecting, revealing the ports for direct fixation thereof to the inner holder plate. This holder may have the terminals for connection to the supply cable directly assembled on its surface, thereby reducing the internal space needs of the connector casing.

The printed circuit may be formed by small fragments or portions separated from each other and joined or related by cables of variable length for passage of the electrical supply and signal. In this manner, the tubular element of the device may also be configured as independent and aligned points of light. Each fragment may comprise a LED diode controller that may comprise from simple supply correcting functions to complex programmes. For example, by using a standard communication protocol we can make the LED diodes switch on and off alternately, producing the sensation of lights that pursue each other.

The LED diodes are preferably of the same colour on the flexible printed circuit, although it is also possible for the diodes to be of different colours in order to allow the variable configuration of the projected light. For example, in a group of LED diodes we can install a red diode, a green diode and a blue diode (RGB configuration) substantially proximate to each other, so that we can observe the combined jointly projected light through the cover. By transmitting an instruction to the controller or through the use of several channels we can make each diode switch on with the adequate intensity so that the chromatic mixture of the three is combined into a considerable colour range.

The device may be used as an emergency signal, as through the adequate use of the group of LED diodes and the correct operating protocol we can obtain lighting comprised of aligned light points in movement. These points offer sharp clear light that penetrates smoke, guiding the rescue of people trapped in a building or facility towards the exit, which is more effective than indications on conventional signs on walls or standard alert lights disposed on evacuation doors.

The device may also be used as a path indicator in hospitals and large buildings, as a substitute for the typical guide bands painted on the floor, as on being luminous they are more visible and easy to follow and do not wear out in walk areas.

DESCRIPTION OF THE FIGURES

In order to complement this description and with the object of helping to understand the characteristics of the invention, a set of drawings has been included in this specification, wherein the following figures have been represented in an illustrative but non-limiting manner.

PREFERRED EMBODIMENT OF THE INVENTION

Figure 1:
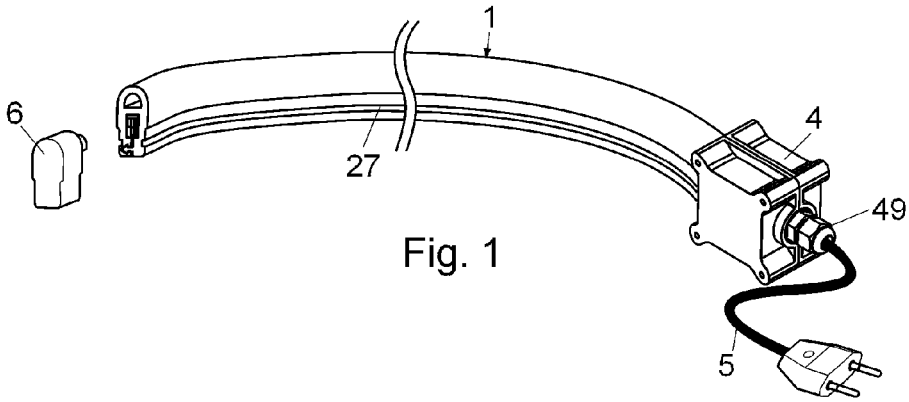
FIG. 1 shows a perspective view of the light device.
Figure 2:
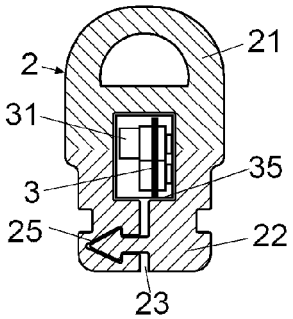
FIG. 2 shows a cross-section of the tubular element with the cover closed and the flexible printed circuit in its interior.
Figure 3:
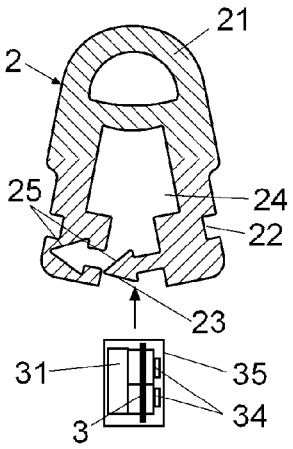
FIG. 3 shows a cross-section of the assembly of the printed circuit on the external cover, with the aperture open for introduction thereof.
Figure 4:
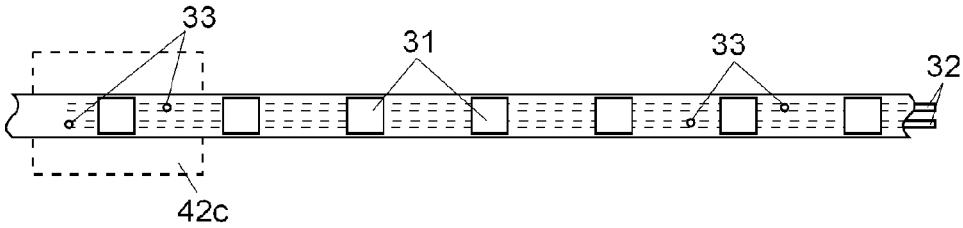
FIG. 4 shows an elevational view of the printed circuit, the luminous LED diodes and the layout of the contact ports.
Figure 5:
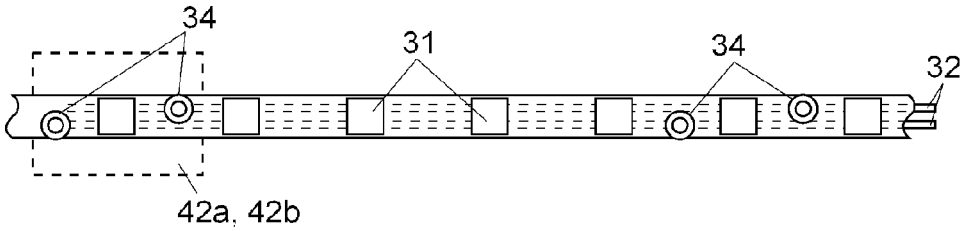
FIG. 5 shows an elevational view of the printed circuit, the luminous LED diodes and the layout of the contact rings.
Figure 6:
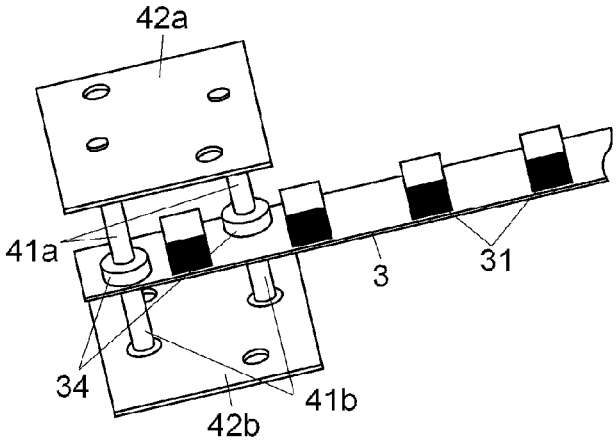
FIG. 6 shows a schematic perspective view of the fixation of the contact pins to a pair of contact rings in the flexible printed circuit.
Figure 7:
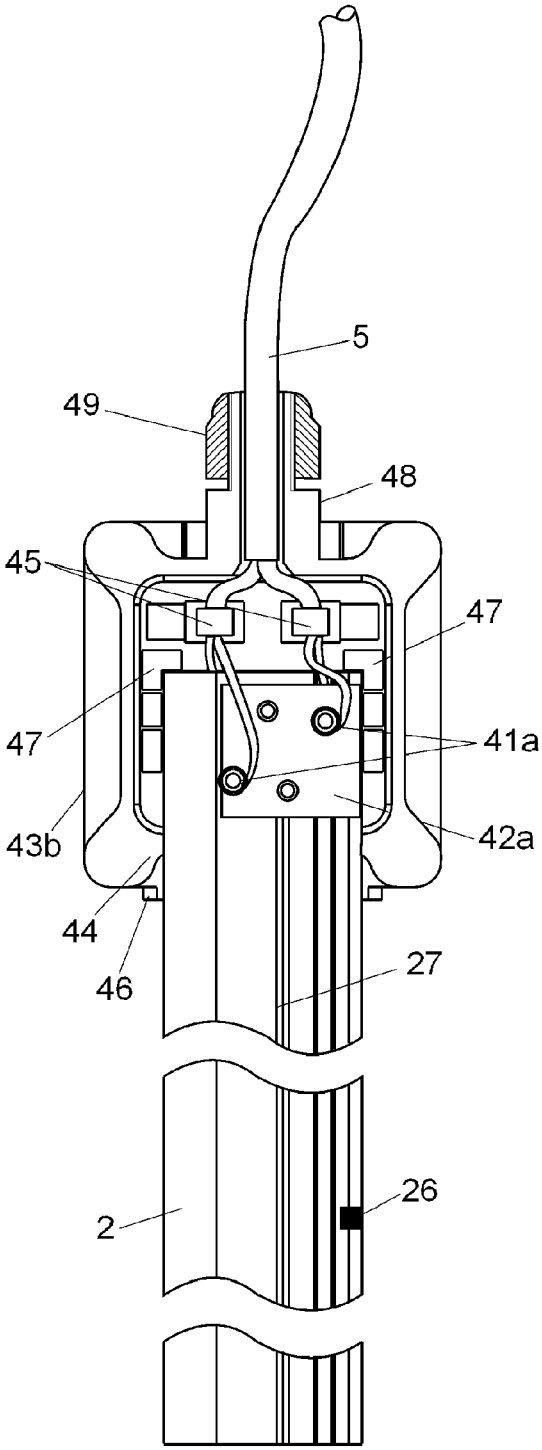
FIG. 7 shows an open plan view of the connection of the tubular element to the electrical connector.
Figure 8:
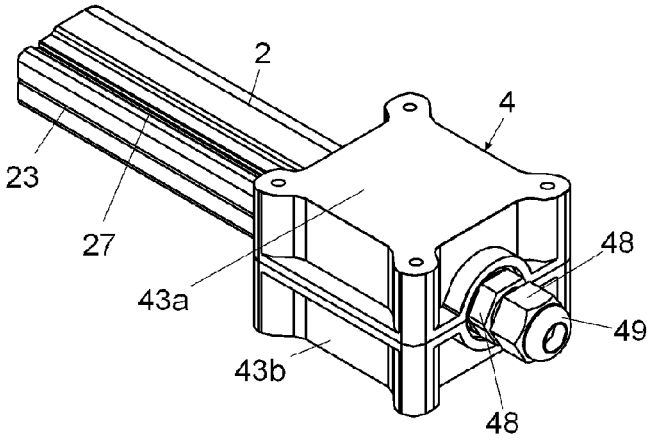
FIG. 8 shows a detailed perspective view of the connection of the preceding figure wherein the watertight closure can be observed.
Figure 9:
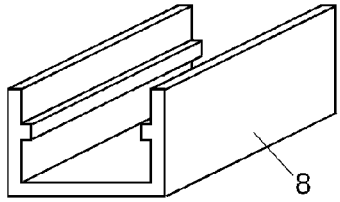
FIG. 9 shows a perspective view of a fragment of the holder profile.

As can be observed in the above-referenced figures, the lighting device is formed by: a tubular element (1), substantially elongated, which comprises a flexible outer cover (2) made of polymer or synthetic materials and an inner printed circuit (3) having a plurality of luminous LED diodes (31), a connector (4) for electrically connecting the printed circuit (3) to a supply cable (5) from a specific power source or mains; and a lid (6) for closing the free end of the cover (2) for the watertightness of the tubular element (1) against environmental agents. Optionally, the device may comprise a fixing element (7), such as a plastic or aluminium profile, discretely disposed staples or similar.

The flexible cover (2) is formed by a coextruded profile having an arched diffuser back, configured in a polymer material of greater flexibility and a base (22), made of a polymer material of greater rigidity, with a longitudinal aperture (23) for accessing the inner recess (24) for reception of the flexible printed circuit (3). This aperture (23) includes a set (25) of male and female configurations, mutually opposed, connectable and disconnectable by pressure, which produces the watertight closure of said inner recess (24), protecting the printed circuit (3), but enabling the possibility of its aperture and closure for installing or exchanging said printed circuit (3). The back (21) of the cover (2) is curved and has a hollow channel in its interior for diffusing the light emitted from the LED diodes (31) of the printed circuit (3) and for providing a cushioning effect when the back (21) is stepped on, struck or deformed. In an alternative embodiment, the cover (2) material may be coloured in the tone deemed convenient to offer an adequate appearance, even if the LED diodes (31) are switched off.

Figure 14:
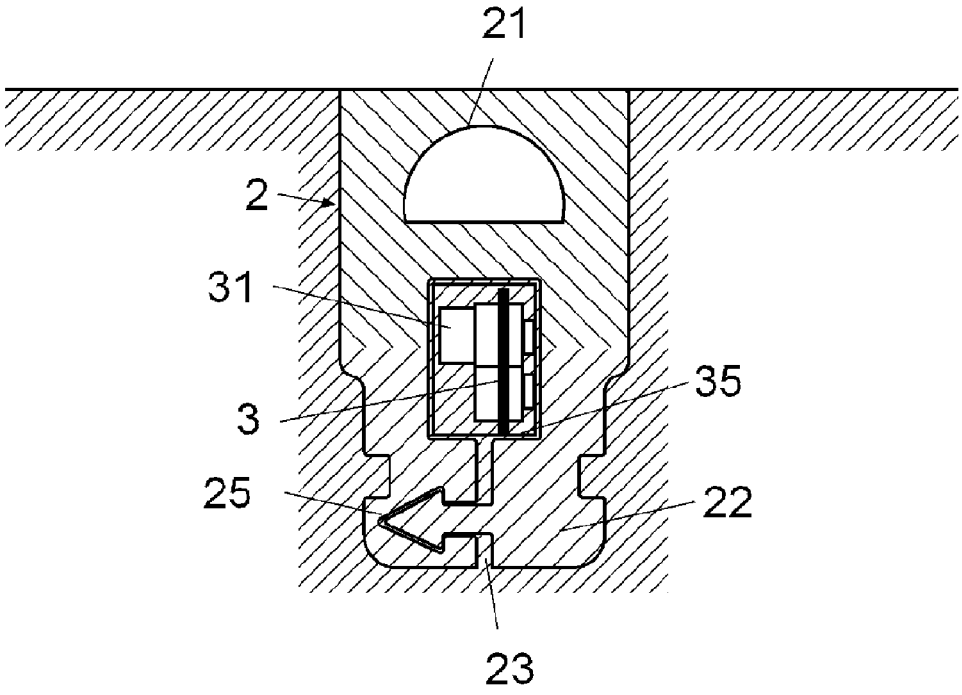
FIG. 14 shows a cross-section of the device embedded in the floor, according to a configuration having a substantially rectangular cross-section, wherein the tubular element shows a flat and levelled back.

As represented in FIG. 14, the back (21) may also be flat to facilitate the embedding of the tubular element (1) in a slot or similar on the same level as the visible upper floor, for example by way of path guide indicator in hospitals or as a watertightness joint, given its flexibility.

The flexible printed circuit (3) is formed by a flexible plate having conducting tracks, preferably double sided; on one side of the printed circuit (3) the LED diodes (31) for lateral lighting are fixed to one side of the printed circuit (3) in order to project the light through the upper back (21) of the cover (2). These LED diodes (31) are connected to a miniature integrated control and monitoring circuit (not represented), forming sets corresponding to consecutive sections of LED diodes (31) throughout the printed circuit (3). Each section is related to at least two electrical supply tracks (32), said tracks (32) being associated to contact ports (33) for connection from the external connector (4). These ports (33) are disposed at different heights with respect to the cross-section of the printed circuit (3) to avoid the reverse-polarisation connection thereof.

In one embodiment, the flexible printed circuit (3) and LED diodes (31) are housed within a tubular protector (35) made of flexible and humidity-insulating polymer.

The cover (2) comprises small marks (26) in correspondence with the location of the ports (33) to facilitate installation of the connector (4) and splicing thereof.

In a first embodiment, these ports (33) have rings (34) which are rigid and include a conical shaped inner outline on either side. The connector (4) comprises a protective casing, two sets of connection pins (41*a*, 41*b*) disposed opposite each other for clamping and fixing of the rings (34) of the printed circuit, disposed between both sets of pins (41*a*, 41*b*), and through the sides of the cover (2) at one end of the tubular lighting element (1), preferably.

Each set of pins (41*a*, 41*b*) is disposed on an independent holder (42*a*, 42*b*), such as a rigid printed circuit board, and is out of phase in height according to the layout of the rings (34), in such a manner that through their installation each ring (34)

is clamped between two conducting pins (41*a*, 41*b*) corresponding to a specific polarisation.

The connector (4) casing is formed by two approximately symmetrical semi-casings (43*a*, 43*b*), configuring an entrance mouth (44) of the tubular element (1) on one side and, on the other, a watertight supply cable (5) exit. Inside the casing there are two terminals (45) for connection to the supply cable (5) poles, being related to the pins (41*a*, 41*b*) of each polarisation by means of conductors to one of said terminals (45).

At the casing mouth (44) there is an elastic watertight joint (46) that fits tightly around the cover (2), while inside the casing there is at least one stop (47) that limits the introduction of the cover (2) end and the printed circuited (3) for installation thereof prior to connection through the pins (41*a*, 41*b*).

Each independent support (42*a*, 42*b*) is solidly joined to one of the semi-casings (43*a*, 43*b*), for example by means of screws, in such a manner that the connection of both semi-casings (43*a*, 43*b*) on the end of the cover (2), comprises the locking and contact of the pins (41*a*, 41*b*) on said cover (2) and with the contact rings (34).

The watertight supply cable (5) exit from the connector (4) casing is formed by two semi-threads (48) respectively disposed on each semi-casing (43*a*, 43*b*) and a gland (49).

In one embodiment, the pins (41*a*, 41*b*) corresponding to the same polarity are of different thickness, wherein the function of ring (34) pusher against the electric contact pin (41*b*) corresponds to a pin (41*a*).

Figure 10:
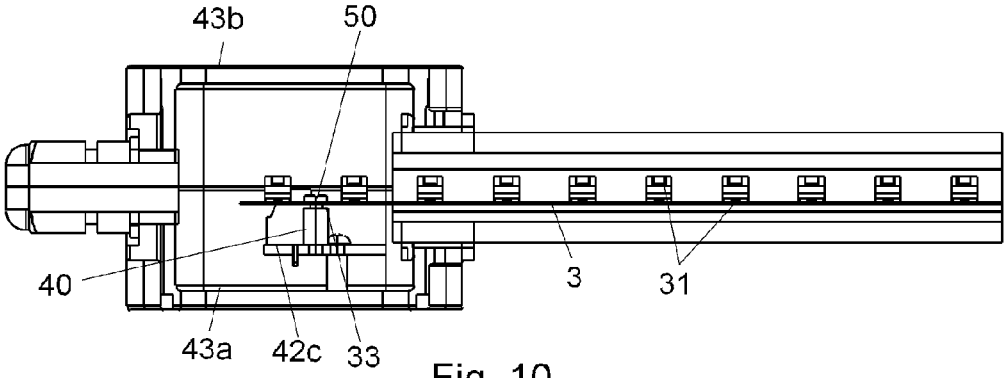
FIG. 10 shows an elevational view with a longitudinal section of the connection of the tubular element according to the second embodiment of the invention.
Figure 11:
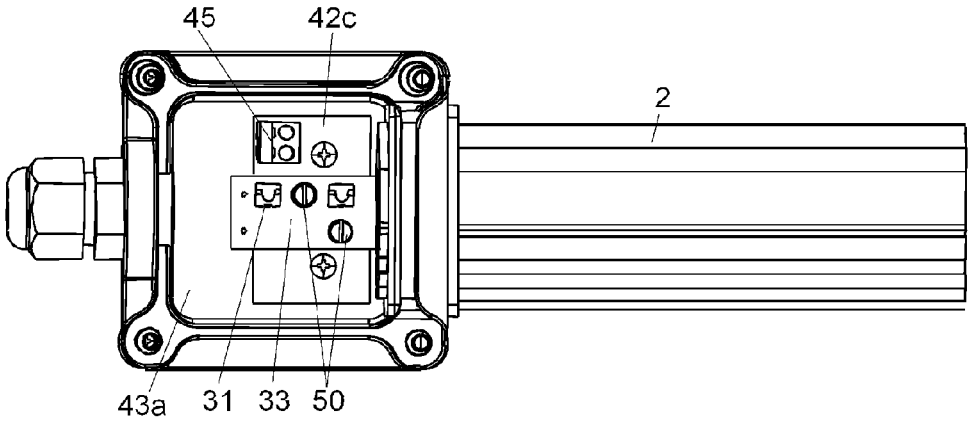
FIG. 11 shows an open plan view of the connection of the tubular element according to the second embodiment of the invention with the flexible printed circuit devoid of the cover.
Figure 12:
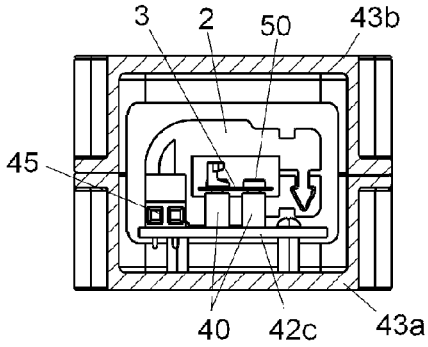
FIG. 12 shows a cross-section of the connection according to the second embodiment of the invention.
Figure 13:
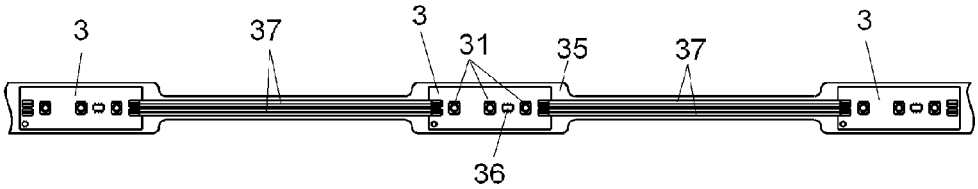
FIG. 13 shows a longitudinal section of a printed circuit formed by portions or fragments separated in order to offer points of light that are spaced out to a greater or lesser degree, and connected by welded conductors.

In a second embodiment represented in FIGS. 10, 11, 12, the contact elements of the connector (4) comprise a holder (42*c*) having two connection contacts (40) wherein screws may be connected, by way of fixing elements (50) of the flexible printed circuit (3), through the ports (33). The cover (2) of the tubular element (1) is cut on entering the connector (4) casing, whereupon the fragment of flexible printed circuit (3) wherein the ports (33) are disposed is shown devoid of said cover on the holder (42*c*) and the contacts (40).

The terminals (45) for connection to the external supply cable (5) are disposed on this holder (42*c*). The holder (42*c*) may be formed by a plate attached to the inner side of one of the semi-casings (42*a*) that form the connector (4) casing.

In one embodiment, the cover (2) has lower slots (27) for fixing the tubular element (1) by means of a holder profile (8).

In an alternative embodiment, the flexible printed circuit (3) is divided into several separate portions on which the diodes (31) are disposed in groups together with a device (36) for controlling operation thereof. The different separate portions are related by means of cables (37) or conducting tracks embedded in a tubular protector (35), in order to configure different points of light throughout the tubular element (1), more or less spaced out and of variable colour, at will from an external device having a standard communication protocol.

Having sufficiently described the nature of the invention, in addition to an example of preferred embodiment, we hereby state for all necessary purposes that the materials, shape, size and layout of the described elements may be modified, provided that it does not represent an alteration of the essential characteristics of the invention which are claimed hereunder.

The invention claimed is:

1. A lighting device, comprising: a tubular element (1) comprising a flexible printed circuit (3) having conducting tracks (32) on which light-emitting diodes (31) are disposed, the conducting tracks (32) including passage ports (33) having electrically conducting connection rings (34) disposed thereon, and a flexible cover (2) having diffusing or coloring properties of the emitted light, the flexible cover (2) including a longitudinal aperture (23) for introducing the flexible printed circuit (3) into a recess (24) of the flexible cover (2), the flexible cover (2) further including a set (25) of integrally formed, mutually opposed, male and female configurations connectable and disconnectable to one another by pressure for watertight closing of the longitudinal aperture (23) and recess (24) after the flexible printed circuit (3) is introduced through the longitudinal aperture (23) and into the recess (24); and an external connector (4) having two sets of electrically conducting connection pins (41*a*, 41*b*) disposed opposite each other for clamping and electrically connecting to the connection rings (34) to supply power to the light emitting diodes (31) from a power supply cable (5).

2. The device according to claim 1, wherein the cover (2) is formed by a profile having a diffuser back (21) configured in a material of greater flexibility and a base (22) in a material of greater rigidity.

3. The device according to claim 1, wherein the ports (33) are disposed at different heights with respect to a cross-section of the flexible printed circuit (3).

4. The device according to claim 1, wherein an outline of a central orifice of the ring (34) has a conical or converging shape on either side of the ring.

5. The device according to claim 1, wherein pins (41*a*, 41*b*) are connected by means of conducting cables to terminals (45) in the external connector (4).

6. The device according to claim 5, wherein each set of connection pins (41*a*, 41*b*) is disposed on an independent holder (42*a*, 42*b*).

7. The device according to claim 6, wherein the independent holder (42*a*, 42*b*) is a printed circuit board.

8. The device according to claim 1, wherein the connector (4) casing is formed by two interconnectable semi-casings (43*a*, 43*b*), defining an entrance mouth (44) of the cover and a supply cable (5) exit.

9. The device according to claim 8, wherein the supply cable (5) exit is carried out by means of two semi-threads (48) and a watertight gland (49).

10. The device according to claim 8, wherein the connector (4) has at least one cover (2) penetration-limiting inner stop (47).

11. The device according to claim 8, wherein the entrance mouth (44) of the connector (4) casing comprises an elastic watertight joint (46), connectable around the cover (2).

12. The device according to claim 8, wherein each independent pin (41*a*, 41*b*) holder (42*a*, 42*b*) is solidly joined to one of the semi-casings (43*a*, 43*b*).

13. The device according to claim 5, wherein the pins (41*a*, 41*b*) corresponding to the same polarity are electrically connected to the same terminal (45).

14. The device according to claim 8, wherein the terminals (45) for connection to the external supply are fixed to an inner side of one or both semi-casings (43*a*, 43*b*).

15. The device according to claim 5, wherein a pin (41*a*, 41*b*) of one polarity is thicker than the complementary pin (41*a*, 41*b*) for centring of the ring (34).

* * * * *